US006249109B1

(12) United States Patent
Kuiri

(10) Patent No.: US 6,249,109 B1
(45) Date of Patent: Jun. 19, 2001

(54) HEAT TRANSFER FROM ACTIVE HIGH DROP REGULATOR

(75) Inventor: Tapio Kuiri, Oulu (FI)

(73) Assignee: Nokia Mobile Phones Limited, Espoo (FI)

( * ) Notice: Subject to any disclaimer, the term of this patent is extended or adjusted under 35 U.S.C. 154(b) by 0 days.

(21) Appl. No.: 09/531,615

(22) Filed: Mar. 21, 2000

(51) Int. Cl.[7] ..... G05F 1/40
(52) U.S. Cl. ..... 323/265; 323/907
(58) Field of Search ..... 323/265, 266, 323/270, 271, 273, 275, 276, 282, 284, 907

(56) References Cited

U.S. PATENT DOCUMENTS

| | | | | |
|---|---|---|---|---|
| 3,869,641 | * | 3/1975 | Goldberg | 315/135 |
| 4,751,524 | * | 6/1988 | Balchunas | 346/108 |
| 4,868,997 | * | 9/1989 | Smock et al. | 34/53 |
| 5,428,682 | * | 6/1995 | Apfel | 379/413 |

* cited by examiner

*Primary Examiner*—Matthew Nguyen
(74) *Attorney, Agent, or Firm*—Perman & Green, LLP

(57) ABSTRACT

In order to limit the heat dissipation within a regulator for controlling the supply to the microprocessor control unit of a communications device, a dropping component is connected in series with the regulator during periods of high battery voltage and is shunted during periods of low battery voltage in the battery charge cycle.

14 Claims, 1 Drawing Sheet

HEAT TRANSFER FROM ACTIVE HIGH DROP REGULATOR

BACKGROUND OF THE INVENTION

Communications devices, such as mobile phones, pagers and the like, are getting smaller and smaller while the demands for added features are expanding. More and more components need to be packed into a smaller envelope. The need to dissipate residual heat from the components is an ever increasing challenge.

In particular, steps must be taken to avoid the overheating of integrated circuits used in these devices to maintain acceptable performance levels. A special temperature issue has arisen in communication devices, in which the voltage required by digital microprocessor controllers has dropped, while battery voltage remains the same. This drop in required voltage causes an increase in the voltage drop which must be accommodated in integrated circuit regulators. With the advent of higher data rates, increase in current consumption will be experienced with a further increase in the heat generated. There is a need, therefore, to prevent the regulator from exceeding its temperature limits without increasing the physical size of the printed circuit board of the device.

It is a purpose of this invention to provide a simple device for reducing the heat generated in an integrated circuit regulator used in a communications device. This is accomplished while taking into consideration the need for preserving current consumption at the low end of the battery charge cycle and while avoiding any space penalty in the printed circuit board.

SUMMARY OF THE INVENTION

In the regulator circuit of a communications device such as a mobile phone, pager, or the like, a voltage dropping component is inserted in series with the integrated circuit regulator. This serves to lower the input voltage to the regulator. The voltage dropping component may be a resistor or diode designed to provide the necessary voltage drop to maintain the regulator within its temperature limits. The resistor could take the form of a long and thin wire printed on the circuit board. Although this voltage loss is not a problem when the battery is fully charged, it may limit phone operation at the lower end of the battery charge cycle. In order to avoid this, a shunt circuit is employed to avoid the temperature limiting voltage drop at low voltage, when it is not needed. The shunt circuit may be actuated by a comparator which compares battery voltage to a predetermined minimum threshold voltage. The comparator activates a transistor or other switching means to short circuit the voltage dropping mechanism.

DESCRIPTION OF THE DRAWING

The invention is described in more detail below with reference to the attached drawing in which.

DESCRIPTION OF THE PREFERRED EMBODIMENT

Figure 1:
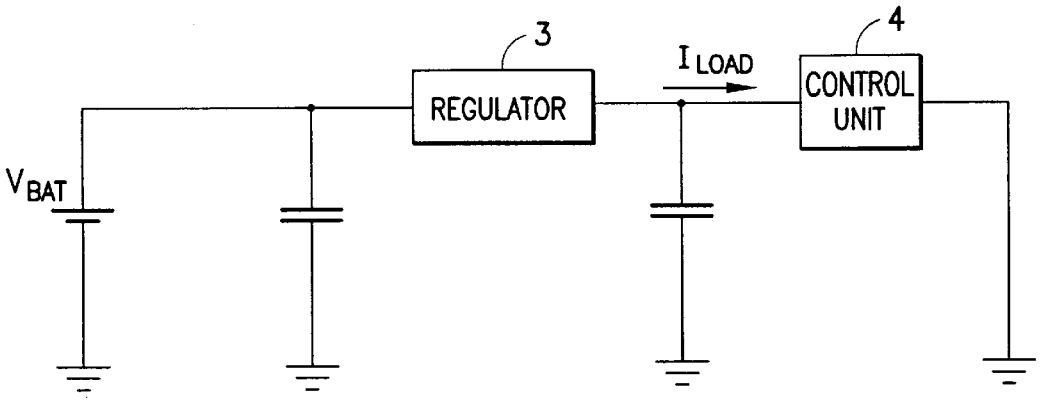
FIG. 1 is a circuit diagram showing a typical regulator circuit.
Figure 2:
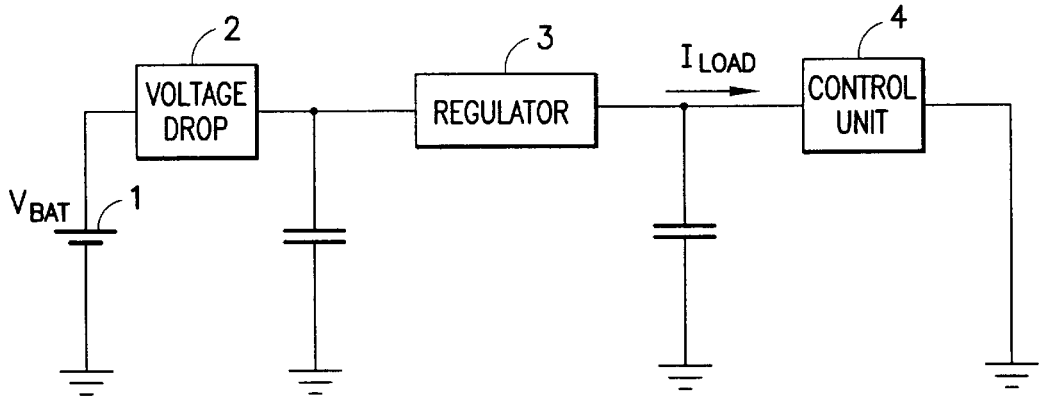
FIG. 2 is a circuit diagram showing a preferred embodiment of this invention.
Figure 3:
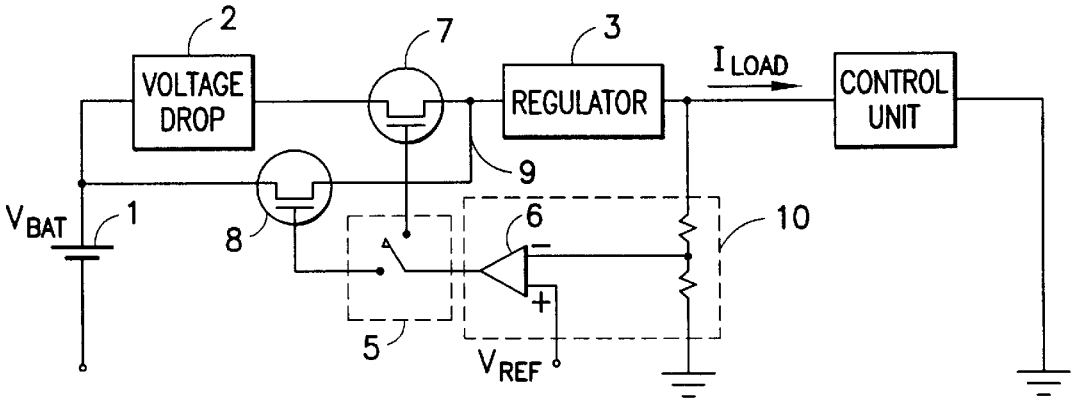
FIG. 3 is a circuit diagram showing an alternative embodiment of this invention.

The basic components of the regulator system of this invention is shown in the block diagram of FIG. 1 and includes a battery 1 which provides a supply voltage ($V_{BAT}$) to the system. As shown in FIG. 2, a voltage dropping component 2 is connected in series with the regulator to reduce the input voltage ($V_{IC}$) to an integrated circuit regulator 3. An integrated circuit voltage regulator 3 supplies the microprocessor control unit 4 of a cellular phone or other device with a substantially constant voltage. The dropping component 2 reduces the voltage ($V_{IC}$) to the integrated circuit regulator 3 in order to reduce heat dissipation within the components of integrated circuit 3.

The voltage dropping component 2 can be a simple resistor whose resistance is calculated to limit the power dissipation which needs to accomplished in regulator 3. Through the action of the component 2, $V_{IC}$ is kept at a manageable level. The same effect can be achieved with a series connected diode or diodes. Although the resistance of the diode is non linear, it produces a more stable voltage drop independent of current. To save space on the printed circuit board, a relatively long thin conductor can be routed in available space or layered under existing components. This would tend to save space and spread the heat over a larger area of the printed circuit board.

Assuming, for the purpose of illustration, that, without the dropping component 2, the $V_{IC}$=3.6V, the voltage required by the controller unit 4 is 1.7V, and $I_{LOAD}$=95 ma; the voltage drop in the regulator 3 would be 1.9V. The power dissipation in the regulator would be 180.5 mW(1.9V×95 ma). To calculate the maximum voltage drop that can be accomplished by the dropping component 2, it is assumed, again for the purpose of illustration, that there is a minimum battery voltage $V_{BAT}$ of 3V and a maximum voltage to the controller unit 4 of 1.9V. With a minimum operational voltage for the regulator 3 of 0.17V, there is an available voltage drop for the component 2 of 0.93V. This would result in the dissipation of 88.35 mW of energy external to the integrated circuit 3 or a savings of 48% of regulator thermal power dissipation. This could be used to reduce, as much as possible, the heat dissipation within integrated circuit 3.

There will be periods, during the battery cycle, when supplemental heat dissipation will not be necessary, namely, as the battery voltage $V_{BAT}$ falls at the end of its discharge cycle. At these times, the voltage drop of the component 2 will tend to shorten the available use of the communications device before recharging is required. To avoid this problem, a circuit 8 is used to sense the output voltage of the battery 1 and compare it to a predetermined value ($V_{REF}$) indicative of the end of the discharging cycle. The dropping component 2 is shorted from the circuit when the battery voltage falls below a predetermined threshold.

To accomplish this, a switching transistor 5 is connected to sensing circuit 8. Transistor 5 controls the connection of the battery to the regulator either through the dropping component 2 or directly to $V_{BAT}$ through shunt 7. Sensing circuit 8 may consist of a comparator 6 connected through a voltage divider 9 to the output of battery 2. Comparator 6 compares $V_{BAT}$ to $V_{REF}$ and triggers transistor 5 when the battery voltage is reduced to a low level in its cycle.

In this manner, the switching component 5 is controlled by the sensing circuit 8, which is constructed to sense the output voltage of battery 1 and compare it to a threshold voltage, $V_{REF}$. $V_{REF}$ is set relative to the voltage at which the need for heat dissipation no longer necessary. Upon the conduction of transistor 5, the regulator 3 is connected, through a shunt 7, directly to $V_{BAT}$, thereby removing the dropping component 2 from the circuit. Dropping component 2 will therefore, remain operational in the circuit until heat dissipation in the regulator 3 is minimal.

The regulator 3 can be any of the known types of integrated circuit voltage regulators and does not form part of this invention. Its purpose is to provide the microprocessor control 4 with substantially constant voltage for operation of the device. As is well known, the operation of the communications device is limited by the battery cycle and it is important to preserve the voltage level in particular at the low end of the cycle.

In this manner the negative effects of the voltage drop provided by the component 2 are overcome while the integrated circuit regulator 3 is protected from excessive heat.

I claim as my invention:

1. In a battery operated device, a circuit for limiting heat dissipation within an integrated circuit component comprising:

a dropping component connected in series between the voltage of said battery and said integrated circuit and constructed to provide a predetermined drop in the voltage input to the integrated circuit component; and a switch module connected to short circuit the dropping component when the battery voltage drops to a predetermined value in the battery charge cycle.

2. In a battery operated device, a circuit for limiting heat dissipation within an integrated circuit as described in claim 1, wherein the voltage dropping component comprises a resistor, the resistance of which is selected to provide a voltage drop to minimize the heat dissipation required in the integrated circuit.

3. In a battery operated device, a circuit for limiting heat dissipation within an integrated circuit as described in claim 1, wherein the voltage dropping component comprises a printed circuit wire routed on available space on a printed circuit board containing the integrated circuit.

4. In a battery operated device, a circuit for limiting heat dissipation within an integrated circuit as described in claim 1, wherein the voltage dropping component comprises a diode, which is selected to provide a voltage drop to minimize the heat dissipation required in the integrated circuit.

5. In a battery operated device, a circuit for limiting heat dissipation within an integrated circuit as described in claim 1, further comprising a voltage monitor connected to sense a voltage indicative of the output voltage of said integrated circuit, compare said voltage to a predetermined minimum threshold, and actuate said switch module when said battery voltage falls below said minimum threshold.

6. In a battery operated device, a circuit for limiting heat dissipation within an integrated circuit component comprising:

a dropping component connected in series between the voltage of said battery and said integrated circuit and constructed to provide a predetermined drop in the voltage input to the integrated circuit component to reduce the voltage drop required to be effected by the integrated circuit; and a switch module connected to short circuit the dropping component when the battery voltage drops to a predetermined value in the battery charge cycle.

7. In a battery operated device, a circuit for limiting heat dissipation within an integrated circuit as described in claim 6, wherein the voltage dropping component comprises a resistor, the resistance of which is selected to provide a voltage drop to minimize the heat dissipation required in the integrated circuit.

8. In a battery operated device, a circuit for limiting heat dissipation within an integrated circuit as described in claim 6, wherein the voltage dropping component comprises a printed circuit wire routed on available space on a printed circuit board containing the integrated circuit.

9. In a battery operated device, a circuit for limiting heat dissipation within an integrated circuit as described in claim 6, wherein the voltage dropping component comprises a diode, which is selected to provide a voltage drop to minimize the heat dissipation required in the integrated circuit.

10. In a battery operated device, a circuit for limiting heat dissipation within an integrated circuit as described in claim 6, further comprising a voltage monitor connected to sense a voltage indicative of the battery voltage, compare said voltage to a predetermined minimum threshold, and actuate said switch module when said battery voltage falls below said minimum threshold.

11. A circuit for limiting heat dissipation within in a battery operated mobile communications device, comprising:

an integrated circuit voltage regulator, said voltage regulator controlling the voltage to a microprocessor controller of said mobile communications device; and a dropping component connected in series between the voltage of said battery and said integrated circuit and constructed to provide a predetermined drop in the voltage input to the integrated circuit component to reduce the voltage drop required to be effected by the integrated circuit.

12. A circuit for limiting heat dissipation within in a battery operated mobile communications device, as described in claim 11, wherein the voltage dropping component comprises a resistor, the resistance of which is selected to provide a voltage drop to minimize the heat dissipation required in the integrated circuit.

13. A circuit for limiting heat dissipation within in a battery operated mobile communications device, as described in claim 11, wherein the voltage dropping component comprises a printed circuit wire routed on available space on a printed circuit board containing the integrated circuit.

14. A circuit for limiting heat dissipation within in a battery operated mobile communications device, as described in claim 11, wherein the voltage dropping component comprises a diode, which is selected to provide a voltage drop to minimize the heat dissipation required in the integrated circuit.

* * * * *